US005533288A

United States Patent [19]

Lambert

[11] Patent Number: 5,533,288

[45] Date of Patent: Jul. 9, 1996

[54] QUICK MOUNT PICTURE FRAME

[76] Inventor: Gary F. Lambert, 834 Lincoln Blvd., Santa Monica, No. 3, Santa Monica, Calif. 90403

[21] Appl. No.: 402,932

[22] Filed: Mar. 13, 1995

[51] Int. Cl.[6] ..... G09F 1/12

[52] U.S. Cl. ..... 40/754; 40/773

[58] Field of Search ..... 40/748, 754, 768, 40/745, 773

[56] References Cited

U.S. PATENT DOCUMENTS

| | | | |
|---|---|---|---|
| D. 304,439 | 11/1989 | Lambert . | |
| 2,273,351 | 2/1942 | Gunder | 40/152.1 |
| 3,553,872 | 1/1971 | Ebner | 40/152 |
| 3,707,791 | 1/1973 | Levy | 40/152.1 |
| 4,014,120 | 3/1977 | Merz | 40/152.1 |
| 4,662,093 | 5/1987 | Suttles et al. | 40/158.1 |
| 4,947,566 | 8/1990 | Hoebel | 40/158.1 |
| 5,081,777 | 1/1992 | Stone et al. . | |
| 5,405,146 | 4/1995 | Washington | 40/152 X |

*Primary Examiner*—Brian K. Green

*Attorney, Agent, or Firm*—Herbert W. Larson; James E. Larson

[57] ABSTRACT

A greeting card picture frame which allows a picture to be easily and quickly mounted. The greeting card picture frame is a unitary integral construction of a decorative border having a filler or block providing a mounting surface for receiving a picture. Double-sided adhesive tape, on the center of the mounting surface, allows a picture to be easily and quickly positioned and secured by pressing it down on the adhesive surface of the tape. A matteboard is then applied that has double-sided adhesive tape securing the picture in the frame. A flat backing having a folding portion approximately equal to the width of the frame provides a self-contained stand or easel. A corner of the folding part is creased to provide a base for displaying the frame and picture on a desk or table top. A mounting hole is also provided in the frame for mounting the picture on a wall and for storing an included push-pin for hanging. A perforated hinge securing the folding portion to the flat backing allows the folding portion of the stand to be detached when the picture is to be mounted on a wall.

9 Claims, 3 Drawing Sheets

QUICK MOUNT PICTURE FRAME

FIELD OF THE INVENTION

This invention relates to picture frames and greeting cards, and more particularly relates to a greeting card picture frame for easily and quickly mounting pictures, artwork and the like.

BACKGROUND OF THE INVENTION

The insertion and mounting of an image in a picture frame is generally complicated. Framed artwork and photographs are relatively expensive and require dexterity to mount the picture, artwork or image of any type. The frames themselves are usually made of wood, but some may be molded synthetic material. They are generally rectangular in shape and having a matte, a backing material and clips to secure a picture in the frame. The frame may have glass covering the image so the frame must be handled carefully.

To mount a picture, the clips are removed and the backing and matte taken out. The picture is then positioned on the backing and fitted into the frame with the matte. Occasionally, the matte may be omitted if the picture is the same size as the opening in the frame. The clips are then replaced, usually with a tack hammer, and the picture is ready for hanging, but not until after some considerable effort.

Attractive greeting cards are now very popular, some of which are worthy of displaying. Often photographs are turned into greeting cards the receiver might want to save and sometimes even display. However, they must then go out, purchase a frame and engage in the tedious task of mounting the photograph or artwork in a frame. It would be advantageous if a frame allowed for the image, photograph or artwork to be easily and quickly mounted with a minimum of fuss, and the frame could be received with the greeting card or even as part of it.

It is one object of the invention to provide a greeting card/picture frame that allows an inexperienced user to easily and quickly mount a picture or the like.

Another object of the invention is to provide a frame that has a mounting surface with a decorative border and an adhesive on the mounting surface to mount a picture.

Yet another object of the present invention is to provide a frame that induces an integral structure that allows a picture to be easily displayed in the frame.

Another object of the present invention is to provide a support integrally formed on the back of the frame that forms a hinged stand.

Still another object of the present invention is to provide a perforation on the hinged stand so that the stand may be easily detached for mounting or hanging the frame with a picture on a wall with an included hanging push-pin stored within a hanging keyhole.

BRIEF DESCRIPTION OF THE INVENTION

The purpose of the present invention is to provide a quick-mount greeting card/picture frame for quickly and easily mounting a picture, artwork or any other image.

The invention provides a system for quickly mounting and displaying photographs, artwork or any flat image directly on a front mounting surface without the problems or difficulties experienced with a conventional frame which is done through the back. The mounting surface is provided by a block of light-weight material having a decorative border around the mounting surface. In a preferred embodiment of the invention, the decorative border is formed by a frame having a cavity similar to conventional frames. The cavity is filled with a lightweight foam material to provide a mounting surface inside and flush with the frame border. Optionally, the decorative bordering frame and lightweight filler may be all one molded piece that has an appearance similar to a conventional frame, but without the need for a glass cover or mounting clips.

To mount a photograph, artwork or any image, an adhesive surface is provided at the center of the mounting surface. Preferably, the adhesive surface is a double-sided adhesive tape having a strong (i.e., hi-tack) adhesive surface on one side and a less strong (i.e., lo-tack) adhesive surface on the other. The hi-tack adhesive secures the tape to the mounting surface with the lo-tack surface exposed. A protective fly or ad sheet sometimes called "release paper" covers the lo-tack adhesive until ready for use. A lo-tack adhesive is all that is necessary for most uses because it will be sufficient for positioning and retaining an image in the frame also allowing for realignment if necessary.

Generally, the picture will be securely held in place by a matteboard sized to fit the inside dimension of the frame thus becoming self-centering within the frame and properly positioned to cover the perimeter of the artwork. The matteboard provides an attractive border around the image being mounted on the frame. Strips of hi-tack double-sided adhesive tape are provided on the down-side of the matteboard to securely hold it in place in the frame. Release tape covers and protects the exposed side of the matteboard hi-tack double-sided tape until the matteboard is ready for use.

Preferably, the decorative boarder or frame of the picture frame provides a recess for receiving and properly positioning the matteboard. The inside dimension of the recess matches the outside dimensions of the matteboard to provide a snug, secure and aligned fit.

As designed, the mounting of a picture, artwork or image in the frame is quick and easy without the difficulties presented by using traditional frames. To mount a picture, the release paper is removed from the double-sided tape exposing the lo-tack adhesive at the center of the mounting surface. The picture is then positioned on the mounting surface. When the user is satisfied the picture is properly positioned, pressure is applied to the picture to bond it to the lo-tack adhesive. A lo-tack adhesive is preferable because, if the picture is not properly positioned, it can be easily lifted and repositioned. The lo-tack adhesive will then hold the picture in place.

The release paper is then peeled off to expose the hi-tack adhesive strips on the down-side of the matteboard. Preferably, there are two strips of hi-tack tape on opposite sides of the matteboard, but more could be used if desired. The matteboard is then positioned in the recess of the frame over the picture and pressed downward to secure the hi-tack adhesive tape to the mounting surface of the frame. The matteboard securely holds the picture on the frame and provides an attractive offset border. The use of a hi-tack tape on the matteboard provides a substantially permanent bond.

The design of the frame allows a person of almost any level of skill to quickly and easily mount a picture that closely resembles custom framing without the fuss of conventional frames. The lightweight design and omission of glass allows a product that is easy to ship and is virtually unbreakable. It can be shipped with or without the art installed and an inexperienced user can easily mount the art or any other flat image.

For display purposes the instant frame design provides for a free standing or on-the-wall display. The self-contained freestanding display is provided by a flat sturdy cardboard or other flat material glued on the back of the frame and filler. The flat backing extends beyond the frame a distance about equal to width of the frame. A hinge is provided by a crease in the flat backing parallel and adjacent to the frame, thus creating a card.

An optional, but preferred, feature is a modification to provide a more stable support which also tilts the frame backward slightly for improved viewing. A foot or base is formed on the folding part of the flat backing by an oblique or diagonal crease extending outward from the hinge to the edge. This allows a user to bend the corner of the folding part under, forming a stable base for displaying the frame and picture on a desk or table top, or the like.

To hang the framed picture on a wall, a slot is formed on the back of the filler or frame. A keyhole-shaped slot is formed for receiving the head of a nail or screw mounted on a wall. Optionally, a push-pin can be stored in the keyhole slot for hanging a framed picture on a wall. The frame is distributed with a push-pin stored in the keyhole mounting slot which eliminates the need for any mounting hardware or use of tools.

When used in this way, the folding part of the flat backing is removed by detaching it along the crease at the edge of the frame. To facilitate removal the crease forming the hinge for the folding part is perforated so that it will tear off without damaging the frame. The folding part and hinge will still be sturdy enough for desk top or table display, but may be detached for wall mounting without the need for tools to cut off the folding part. The perforation in the hinge allows removal of the folding part by carefully tearing it away at the hinge.

The above and other novel features of the invention will be more fully understood from the following detailed description and the accompanying drawings, in which:

DETAILED DESCRIPTION OF THE INVENTION

Figure 1:
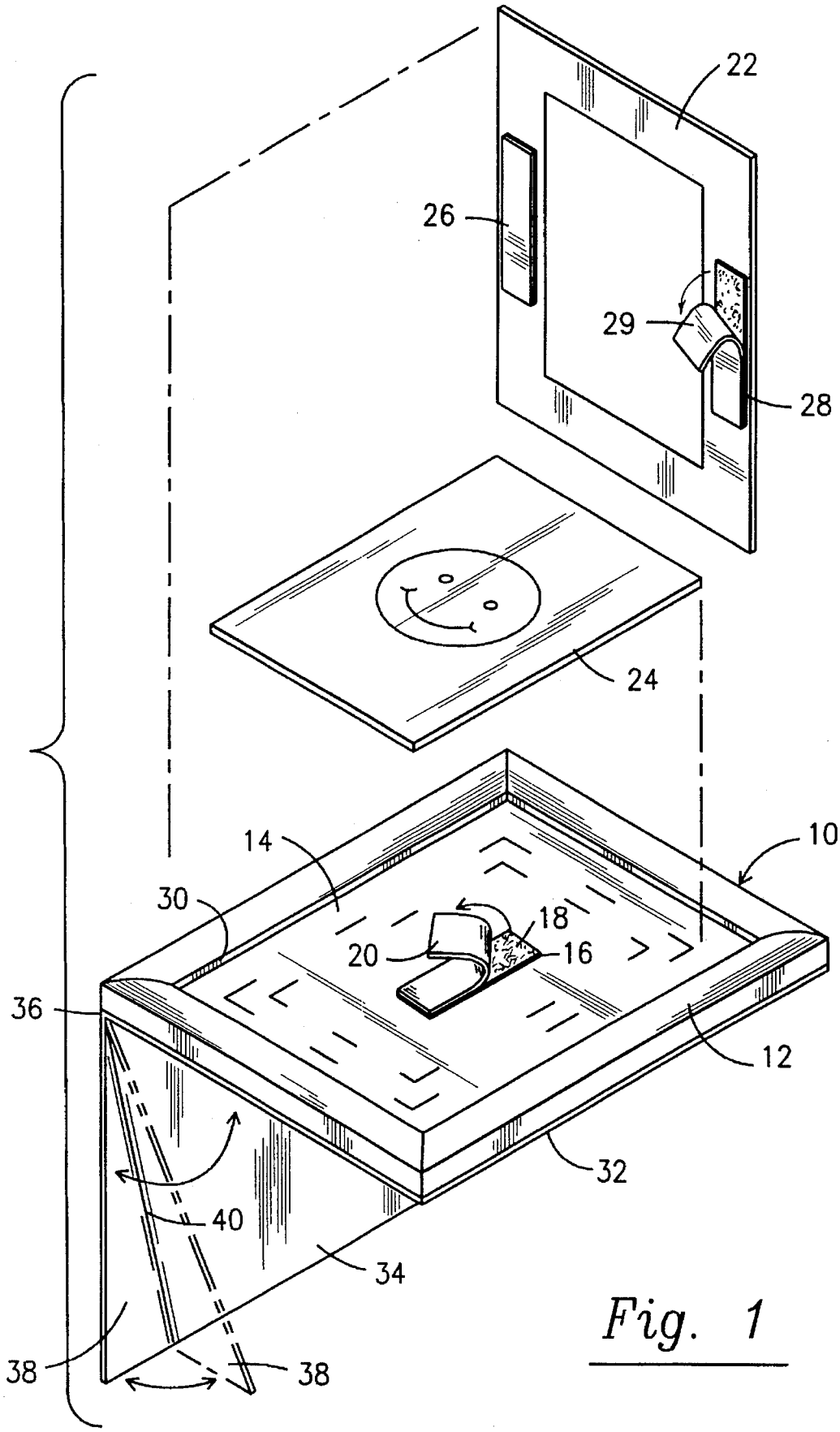
FIG. 1 is an exploded perspective view of a greeting card picture frame according to the invention.

A greeting card picture frame that can be quickly and easily assembled by any inexperienced user is illustrated in FIG. 1. The picture frame 10 has a decorative border 12 forming a mounting surface 14 flush with the frame 10. Double-sided adhesive tape 16 is provided at the center of mounting surface 14. Preferably double-sided adhesive tape 16 has a strong adhesive on the surface pressed against the mounting surface 14, and a low strength (i.e., lo-tack) adhesive 18 on the opposite or upper side. A release paper 20 covers the lo-tack adhesive until ready for use.

Figure 2:
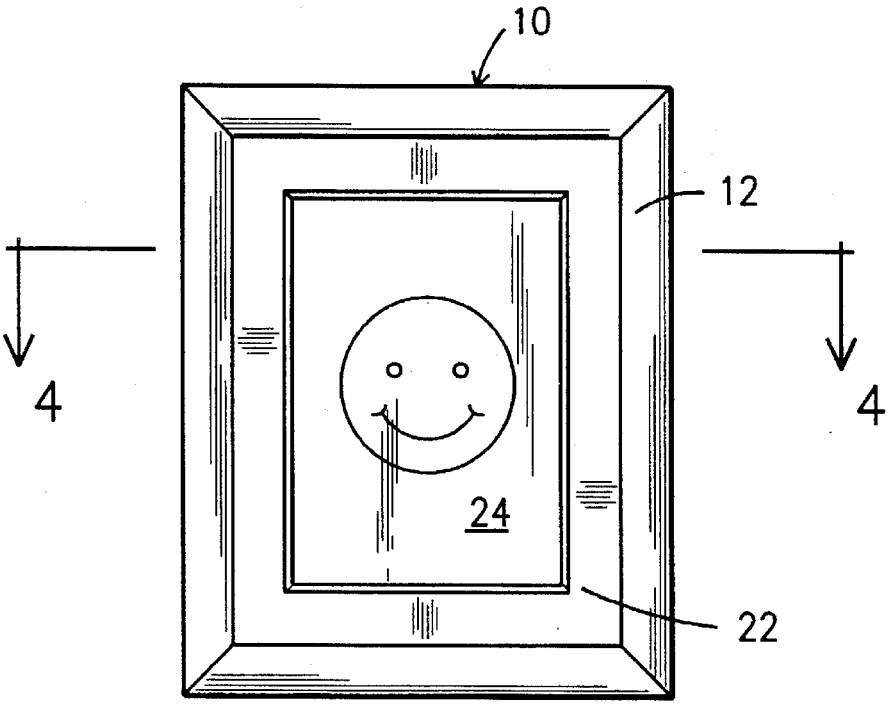
FIG. 2 is a front view of the greeting card picture frame having a picture mounted.

A matteboard 22 is provided to hold a picture, artwork or image in place on mounting surface 14. Double-sided hi-tack adhesive tape strips 26 and 28 are provided along the sides of matteboard 22. Hi-tack strips 26 and 28 are covered with release paper 27 and 29 until ready to use. Preferably, double-sided adhesive tape 26 and 28 has a strong (i.e., hi-tack)adhesive to firmly hold the picture, artwork or image 24 in place on mounting surface 14. Frame 10 is constructed to have a recess 30 with dimensions that equal the outside dimensions of matteboard 22. This allows matteboard 22 to firmly seat in decorative border 12 on mounting surface 14 to securely hold picture 24 in the frame, as show in FIG. 2.

Figure 4:
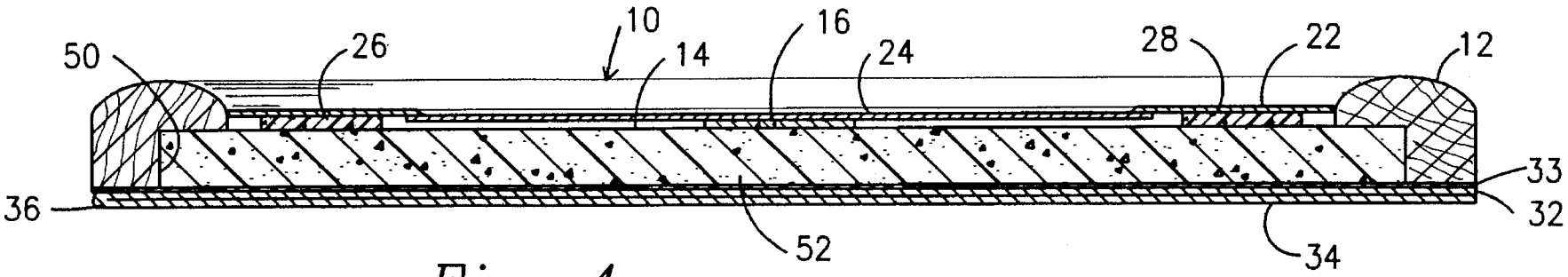
FIG. 4 is a sectional view taken at 4—4 of FIG. 2.

An optional, but preferred, feature of the invention is the inclusion of its own self-contained easel or stand and structure that allows mounting either on a desktop, table top, or on the wall. A stand is formed by a flat backing 32 securely fastened by an adhesive 33 to the rear of frame 10 as illustrated in FIG. 4. The flat back 32 has an extended portion 34 equal approximately to the width of frame 10 or less that provides a stand to mount the frame and picture in a vertical position. Flat folding part 34, of the stand, is formed by creasing flat backing 32 along edge 36 of frame 10. This allows flat backing 32 to fold flat against the back of frame 10 as illustrated in FIG. 4. To mount the frame 10 with a picture 24 on a desk or table top, folding portion 34 is opened from frame 10 and will provide support.

Another optional, but preferred, feature is to provide a base for increased stability and to allow picture 24 in frame 10 to be tilted for improved viewing. Base 38 is provided by forming an oblique or diagonal crease 40 extending from corner 42 to an edge of folding part 34 slightly above corner 44. When folded under, as illustrated in phantom in FIG. 1, triangular area or base 38 formed by crease 40 will provide a stand supporting frame 10 for displaying picture 24 at a slighted tilt angle for improved viewing.

Figure 3:
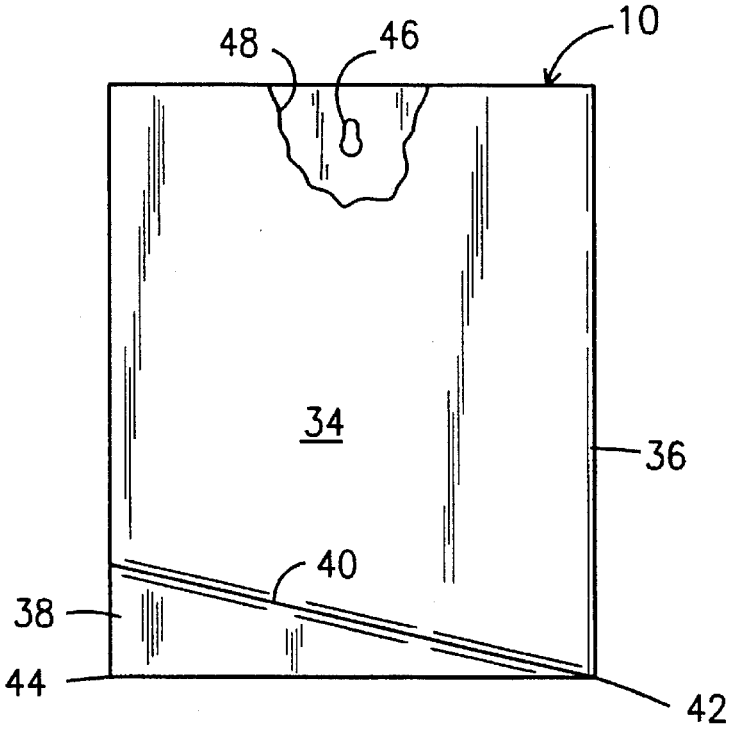
FIG. 3 is a rear view of the greeting card picture frame of FIG. 1.

Still another optional, but preferred, feature is the inclusion of a mounting hole 46 in the form of a keyhole slot in the back of frame 10 as shown in the area broken away at 48, in FIG. 3. This allows frame 10, with picture 24, to be easily mounted on a wall. As an option, a push-pin can be stored in keyhole slot 46 for hanging the picture frame. When mounting frame 10, with picture 24 on a wall, folding part 34 of the stand is preferably removed. To aid in removing folding part 34, hinge 36 formed by creasing flat backing 32 along the edge of frame 10 is perforated. This allows folding part 34 to be detached from frame 10 when it is preferred to have a wall mounted picture. To mount frame 10 with picture 24 on a wall, folding part 34 can be carefully detached by tearing at hinge 36 with the assistance of the perforations, without damaging the frame. A push-pin (not shown) stored in keyhole slot 46 can then be used to mount the frame and picture on a wall.

Figure 5:
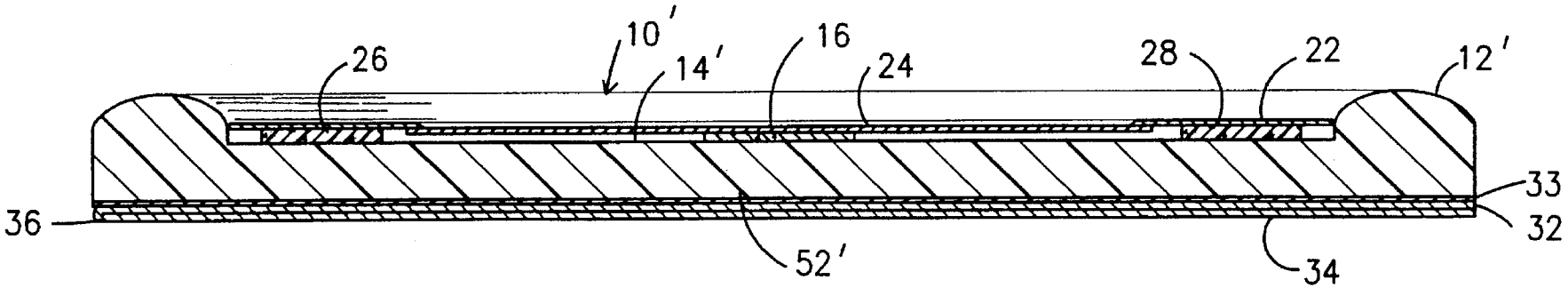
FIG. 5 is a sectional view of an optional embodiment of the invention.

A unique feature of the invention is that the frame may be an integral construction with the mounting surface being exposed. There are no parts to disassemble for mounting a picture, artwork or image. The construction of two such embodiments is illustrated in FIGS. 4 and 5. In FIG. 4, the instant picture frame is illustrated having a decorative border 12 that has a cavity 50 similar to traditional frames. This cavity is filled with a lightweight, preferably foam material 52 having a covering providing mounting surface 14. Proper construction of foam material 52 can produce an integrally formed flat durable mounting surface 14 on the top.

Preferably, foam material 52 is secured in frame 12 to provide an integral one-piece frame that needs no disassembly for mounting a picture, artwork or image. After constructing frame 12 with filler or block 52, flat backing 32 is securely attached to the back of frame 10 with an adhesive 33 and creased to form hinge 36 along one edge. The crease is also perforated to allow removal of folding part 34 for wall mounting.

An optional one-piece molded construction is illustrated in FIG. 5. In this embodiment, frame 10' is formed with a molded decorative border 12', which can have a variety of designs, formed on a block of molded material 52' having mounting surface 14'. Flat backing 32 forming hinge 36 and folding part 34 is securely attached to the back of molded block 52' as before.

Matteboard 22 and picture 24 are secured to mounting surface 14' as before with double-sided adhesive tape 16, 26 and 28.

With the unique greeting card picture frame design and constructed as shown, a person can put together a framed picture quickly and easily, and add their own "personal touch" by writing on the interior of the surface formed by the flat backing and folding part 34 just as they would write on a greeting card. The design incorporates the best features of a greeting card and picture frame allowing a person to construct their own greeting card, which can be quickly and easily assembled and mailed without danger of damage that can occur to conventional glass-faced frames. It has a sturdy and attractive appearance that will encourage the receiver to keep it rather than discard it in the manner of most greeting cards.

To use the greeting card picture frame, a user positions picture 24 on mounting surface 14 after removing release paper 20 to expose lo-tack adhesive surface 18. The use of lo-tack adhesive surface 18 allows a user to remove and reposition picture 24 as needed to get it "just right." Picture 24 is held securely in place by pressing it down firmly on lo-tack adhesive 18. Matteboard 22 then finishes the assembly to secure picture 24 in frame 10. Matteboard 22 is installed by removing release paper 27 and 29 exposing adhesive on hi-tack double-sided adhesive tape 26 and 28. Matteboard is then pressed into recess 30 in frame 12 so that hi-tack adhesive 26 and 28 is securely bonded to mounting surface 14. With these quick and easy steps picture frame 10, with picture 24 installed, is now ready for display.

The picture can be displayed by opening folding part 34 and bending corner 30 to form base 38. To mount on a wall, folding part 34 can be carefully detached by tearing at perforations along hinge 36 to expose mounting hole 46. Mounting hole 46 is in the form of a keyhole slot for receiving a nail or screw head or an included push-pin stored in the keyhole slot.

Decorative border 12, or 12', in FIG. 5 can have any sculptured design appearance used in conventional or traditional frames. This is simply a matter of molding the decorative border 12' with an appropriate design.

Thus, there has been disclosed a greeting card picture frame which allows pictures to be quickly and easily mounted by any inexperienced user with the appearance of custom-framed pictures. The frame provides a solid one-piece construction with a decorative sculptured border and a mounting surface on a filler or molded integrally formed block material.

Double-sided adhesive tape, in the center of the mounting surface, allows a picture to be easily positioned for display. A matteboard provided with double-sided adhesive tape along each side firmly holds a picture on the mounting surface.

This invention is not to be limited by the embodiment shown in the drawings and described in the description, which is given by way of example and not of limitation, but only in accordance with the scope of the appended claims.

What is claimed is:

1. A quick mounting picture frame comprising, a block of foam having a planar upper surface for receiving a picture and a lower planar surface attached to a flat cardboard backing, a double sided adhesive tape attached on one side to the upper surface of the block of foam, and for attaching a second side to a back surface of the picture, a matte board having an inner opening dimension sufficient to display the picture and a pair of oppositely positioned double sided adhesive tape strips adhered to a lower surface of the matte board on a first side and to the planar upper surface of the block of foam on a second side, a decorative frame attached to and enclosing an outer edge of the block of foam, a recess along an inner edge of the decorative frame having a depth sufficient to receive a periphery of the matte board, and a means to support the picture frame incorporated within the flat cardboard backing.

2. The picture frame according to claim 1 in which said means to support the picture frame comprises a stand formed by the flat cardboard backing hingedly attached to one edge of said block of foam.

3. The picture frame according to claim 2 in which said hingedly attached stand comprises the flat cardboard backing secured to the lower surface of said block of foam;

a portion of said flat cardboard backing extending beyond an edge of said block of foam; a crease in said flat cardboard backing along said edge of said block of foam forming a hinge; whereby the portion of said flat cardboard backing extending beyond said block of foam forms said stand.

4. The picture frame according to claim 3 including a foot formed on said hingedly attached stand to support said picture frame at a slightly tilted vertical angle.

5. The picture frame according to claim 4 in which said foot is formed by a crease in a corner of said portion of said flat cardboard backing extending beyond the edge of said block of foam.

6. The picture frame according to claim 3 in which said crease, in said flat cardboard backing, along said edge of said block of foam is perforated; whereby a folding portion of said flat cardboard backing extending beyond the edge of said block of foam may be easily separated from said block of foam.

7. The picture frame according to claim 6 including a slot formed in the lower planar surface of said block of foam; said slot constructed to allow said frame to be mounted on a wall when said folding portion is detached.

8. The picture frame according to claim 1 in which said double sided adhesive tape second side in each instance has release paper covering the second side whereby said release paper can be peeled off to quickly mount the picture and said matte board.

9. The picture frame according to claim 1 in which said decorative frame has a cavity along an inside periphery of said decorative frame for receiving an outer edge of the block of foam.

* * * * *